US006632403B1

(12) United States Patent
Barmore et al.

(10) Patent No.: US 6,632,403 B1
(45) Date of Patent: Oct. 14, 2003

(54) FORSENIC EVIDENCE CONTAINER

(75) Inventors: Charles R. Barmore, Moore, SC (US); Charles Kannankeril, North Caldwell, NJ (US); Rengan Kannabiran, Wayland, MA (US)

(73) Assignee: Sealed Air Corporation (US), Duncan, SC (US)

( * ) Notice: Subject to any disclaimer, the term of this patent is extended or adjusted under 35 U.S.C. 154(b) by 18 days.

(21) Appl. No.: 09/605,625

(22) Filed: Jun. 28, 2000

(51) Int. Cl.[7] ..... B65D 30/10

(52) U.S. Cl. ..... 422/102; 206/223; 206/459.1; 383/5; 383/127

(58) Field of Search ..... 422/99, 102, 61; 436/808; 383/127, 84, 5; 206/223, 449, 459.1, 802

(56) References Cited

U.S. PATENT DOCUMENTS

| | | | | |
|---|---|---|---|---|
| 4,712,729 A | | 12/1987 | Craig | 229/72 |
| 4,777,780 A | | 10/1988 | Holzwarth | 53/432 |
| 4,818,488 A | | 4/1989 | Jacob | 422/23 |
| 4,861,632 A | | 8/1989 | Caggiano | 428/35.2 |
| 5,025,920 A | * | 6/1991 | Walsh et al. | 206/223 |
| 5,205,649 A | | 4/1993 | Fullerton | 383/5 |
| 5,322,161 A | | 6/1994 | Shichman et al. | 206/204 |
| 5,352,041 A | | 10/1994 | Fullerton | 383/5 |
| 5,631,068 A | | 5/1997 | Smith | 428/195 |
| 5,635,917 A | | 6/1997 | Todman | 340/825.37 |
| 5,780,305 A | | 7/1998 | Chisum | 436/174 |
| 5,798,169 A | | 8/1998 | Smith | 428/212 |
| 5,962,333 A | * | 10/1999 | Incorvia et al. | 422/56 |
| 6,032,474 A | | 3/2000 | Dale et al. | 62/239 |
| 6,187,269 B1 | * | 2/2001 | Lancesseur et al. | 422/58 |
| 6,264,033 B1 | * | 7/2001 | Kannabiran et al. | 206/459.1 |

FOREIGN PATENT DOCUMENTS

| | | |
|---|---|---|
| EP | 0 259 068 A1 | 8/1987 |
| EP | 0 899 208 A1 | 9/1997 |

OTHER PUBLICATIONS

RD 408117, Apr. 10, 1998.(two page abstract).

Dupont® Tyvek® Spunbonded Olefin—Product, Properties, and End–Uses, pp. 1–19.

* cited by examiner

*Primary Examiner*—Lyle A. Alexander
(74) *Attorney, Agent, or Firm*—Mark B. Quatt

(57) ABSTRACT

A forensic evidence container includes a first flexible panel, the first flexible panel including a material having a moisture vapor transmission rate of at least 10 gm/24 hours-100 square inches; a second flexible panel, the second flexible panel including a material having a moisture vapor transmission rate of equal to or less than 5 gm/24 hours-100 square inches; an opening capable of providing access to the interior of the forensic evidence container; an adhesive, applied to the first panel or second panel, having a free surface so arranged as to seal the opening on superposition of the first panel and the second panel; and a tamper evident device arranged on the first or second panel. A peelable flexible third panel, including a material having a moisture vapor transmission rate of equal to or less than 5 gm/24 hours-100 square inches, can optionally be peelably adhered to the first flexible panel.

18 Claims, 7 Drawing Sheets

FORSENIC EVIDENCE CONTAINER

FIELD OF THE INVENTION

The present invention relates to forensic evidence containers, such as envelopes, bags, or pouches.

BACKGROUND OF THE INVENTION

Forensic evidence generally relates to evidence collected at a crime or accident scene, or otherwise collected or stored in the course of a criminal, accident, medical, or like investigation. Such evidence can often be organic in nature, such as in the form of blood or tissue samples, DNA samples, human remains, or any other object, article, or sample, such as clothing or personal effects, that has actual or potential utility in connection with the investigation of a crime or accident, or medical inquiry. Such evidence often holds legal and sometimes criminal implications. Thus, it is desirable to preserve the condition of such evidence. In particular, it is desirable to be able to control the loss or retention of moisture of the evidence stored inside a container used to hold the evidence.

Currently, forensic evidence is typically gathered in Kraft paper bags, or polypropylene bags.

The Kraft paper bag usually has acceptable moisture vapor transmission rates. Unfortunately, however, the Kraft paper bag is susceptible to moisture absorption and structural weakening. Thus, for example, Kraft paper bags should not be used in rainy or damp weather, unless protected by a second, plastic, bag. In addition, the Kraft paper bag is susceptible to tampering by an unauthorized individual. Also, the Kraft paper bag is typically opaque. This feature is often detrimental in end-uses such as forensic evidence, where the visibility of the forensic evidence can be important.

Polypropylene bags are not susceptible to moisture absorption and structural weakening, and are typically transparent. However, these and other plastic bags do not allow for drying of a wet object. This can lead to the growth of bacteria and fungi which can destroy or otherwise undesirably and irreversibly physically or chemically alter the forensic evidence.

Both the Kraft paper and polypropylene bags are subject to tampering by unauthorized persons.

The present invention addresses these shortcomings in the art by providing a container for packaging forensic evidence, which container offers an acceptable moisture vapor transmission rate (MVTR), resistance to moisture absorption and structural weakening, transparency, and tamper evidence.

SUMMARY OF THE INVENTION

In a first aspect, a forensic evidence container comprises a first flexible panel, the first flexible panel comprising a material having a moisture vapor transmission rate of at least 10 gm/24 hours-100 square inches; a second flexible panel, the second flexible panel comprising a material having a moisture vapor transmission rate of less than 5 gm/24 hour-100 square inches; an opening capable of providing access to the interior of the forensic evidence container; an adhesive, applied to the first panel or second panel, having a free surface so arranged as to seal the opening on superposition of the first panel and the second panel; and a tamper evident device arranged on the first or second panel.

In a second aspect, a forensic evidence container comprises a first flexible panel having a first and second side edge, and a bottom edge, the first flexible panel comprising a material having a moisture vapor transmission rate of at least 10 gm/24 hour-100 square inches; a second flexible panel having a first and second side edge, and a bottom edge, the first and second side edges in communication with the first and second edges respectively of the first panel, and the bottom edge in communication with the bottom edge of the first panel, the second flexible panel comprising a material having a moisture vapor transmission rate of less than 5 gm/24 hour-100 square inches; a bottom portion formed by the bottom edge of the first panel and the bottom edge of the second panel; an opening capable of providing access to the interior of the forensic evidence container; an adhesive, applied to the first panel or second panel, having a free surface so arranged as to seal the opening on superposition of the first panel and the second panel; and a tamper evident device arranged on the first or second panel.

In a third aspect, a package comprises a) a forensic evidence container comprises a first flexible panel, the first flexible panel comprising a material having a moisture vapor transmission rate of at least 10 gm/24 hour-100 square inches; a second flexible panel, the second flexible panel comprising a material having a moisture vapor transmission rate of less than 5 gm/24 hour-100 square inches; an opening capable of providing access to the interior of the forensic evidence container; an adhesive, applied to the first panel or second panel, having a free surface so arranged as to seal the opening on superposition of the first panel and the second panel; and a tamper evident device arranged on the first or second panel; and b) a forensic evidence article disposed inside the container of a).

Definitions

"Container" herein refers to a bag, envelope, or pouch.

BRIEF DESCRIPTION OF THE DRAWINGS

A detailed description of preferred embodiments of the invention follows, with reference to the attached drawings, wherein.

DETAILED DESCRIPTION OF THE INVENTION

Figure 2:
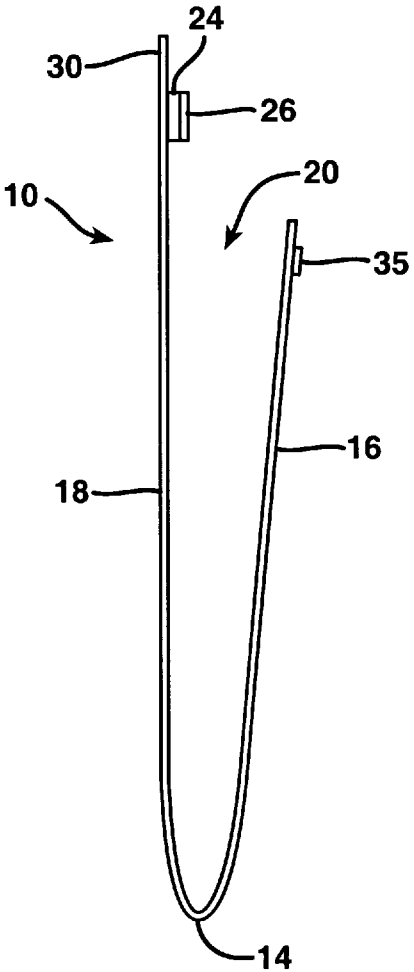
FIG. 2 is a diagrammatic cross-sectional side view of the forensic evidence container of FIG. 1.

A container in accordance with the invention preferably includes a sealing mechanism, and/or resealing mechanism. This mechanism can be in the form of a heat seal, a zipper such as a pinch zipper or slide zipper, or a peelable adhesive.

For specific applications where security and tamper evidence is desired, e.g. in the case of forensic evidence associated with a crime, an appropriate security (tamper evident) device can be installed on or formed as part of the container. If installed on the container, the security (tamper evident) seal can be in the form of a tape that is adhered to a panel of the container.

The tamper evident device can also function as the sealing mechanism disclosed above, or can be a separate and discrete feature of the container. Typically, a closure portion such as a closure flap is arranged to be superposed over a front panel of the container after the evidence has been placed inside the container. The closure flap is formed by providing a rear panel that is longer than a corresponding front panel, such that the additional incremental length of the rear panel, or a portion thereof, can be folded over and in contact with the front panel when the evidence had been placed inside the container.

Alternatively, the closure flap can be formed by providing a front panel longer than a rear panel, such that the additional incremental length of the front panel, or a portion thereof, can be folded over and in contact with the rear panel. The disclosure and examples herein should be read to include either alternative as desired in a particular package configuration.

Closure is effected by means of a band of high-tack adhesive which is applied. across the closure portion or the portion having the opening, for example from the molten state, from transfer tape, solvent cast or in the form of a tape. The adhesive may be pressure sensitive adhesive, and suitable adhesives include thermoplastic hot melt adhesives, silicone adhesives, acrylic pressure sensitive adhesives, solvent cast adhesives, UV (ultraviolet) or EB (electron beam) cured acrylic adhesives, and the like.

Such adhesives are required to have high initial tack with respect to the surface of the sheet material and also to have high adhesive and cohesive strength. In order to provide a visible indication of any attempt to open the tamper evident container by separating the closure portion and the portion having the opening, the adhesive should be strong enough to cause stretching, tearing, or other mechanical distortion of the portions upon attempted opening of the container. If desired, perforations or serrated edges may be provided in the closure portion to indicate tearing and emphasize the effect. With the exception of silicone adhesives, adhesives suitable for the closure of tamper evident containers have a softening temperature which is below the melting point of the closure portion and of the sheet material. The softening temperature is commonly in the range of between 50° C. and 90° C. Accordingly, by the local application of heat, an unauthorized person can open and reseal the tamper evident container without any visible indication that the tamper evident container has been opened. To discourage this practice, thermochromic inks have been used in tamper evident containers. These inks are formulated to develop a permanent, nonreversible, and visibly evident color change when the adhesive on the envelope is exposed to heating. In this way, if unauthorized access to e.g. a tamper evident container is attempted by means of local application of heat to an adhesive on the envelope, a color change in the ink makes this evident. Typical conventional thermochromic inks for this application are formulated from a leuco dye, a phenolic compound, an organic diluent, water, and polyvinyl alcohol. A thermochromic ink composition with improved wet abrasion resistance includes, in addition to the basic formulation of conventional inks, hydrolyzed poly(vinyl acetate) and an organic compound with at least one carbonyl group, preferably an aldehyde and more preferably a dialdehyde such as glyoxal. This improved ink composition is the subject of U.S. patent application Ser. No. 09/525,720 filed Mar. 14, 2000 assigned to a common assignee with the present application, and incorporated herein by reference in its entirety.

Any appropriate tamper evident device, including any tamper evident tape, can be used in connection with the invention. Various devices are disclosed in U.S. Pat. Nos. 4,712,729 (Craig), 5,205,649 (Fullerton), 5,352,041 (Fullerton), 5,631,068 (Smith), 5,635,917 (Todman), and 5,798,169 (Smith), all incorporated herein by reference in their entirety. Also, the tamper evident devices of U.S. Ser. No. 60/143,210 filed on Jul. 9, 1999 and re-filed as U.S. Ser. No. 09/524,946 on Mar. 14, 2000; and U.S. Ser. No. 08/999,179 filed on Dec. 29, 1997, can be used in connection with the present invention, and are both incorporated herein by reference in their entirety. U.S. Ser. No. 09/524,946 discloses an article, such as a tamper evident container, including an indicator having a first layer including a thermochromic ink composition, and a second layer, disposed on the first layer, having a composition different from the ink composition of the first layer. The first and/or second layer can be in the form of a message. The second layer can be a non-thermochromic ink. U.S. Ser. No. 08/999,179 discloses a saliva-evident tamper evident device.

The tamper evident device can comprise a composition such as thermochromic ink; non-thermochromic ink; aqueous evident ink: mechanical evident ink; solvent evident ink; and deactivating agent.

Figure 1:
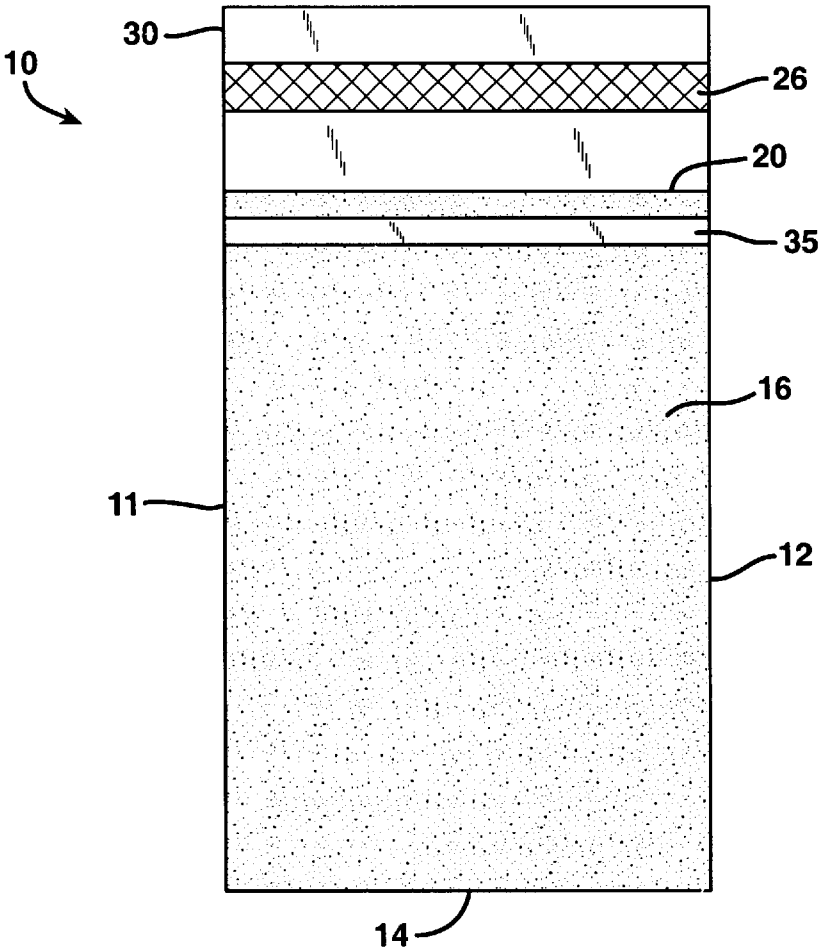
FIG. 1 is a diagrammatic front view of an open forensic evidence container in accordance with a first embodiment of the present invention.

Referring to FIGS. 1 and 2, the forensic evidence container 10 is preferably formed from a flexible front panel 16 and a flexible rear panel 18, each comprising thermoplastic material.

The front panel 16 has an MVTR of at least 10 gm/24 hours-100 square inches, preferably at least 50 gm/24 hours-100 square inches, more preferably at least 100 gm/24 hours-100 square inches, such as at least 1000, at least 5,000, and at least 10,000 gm/24 hours-100 square inches (ASTM F 1249 for values at 20 grams or lower, ASTM E 96 for values above 20 grams, at 100% relative humidity). Preferred MVTR ranges are between 10 and 10,000 gm/24 hours-100 square inches, more preferably between 10 and 5000 gm/24 hours-100 square inches, such as between 50 and 1000, between 100 and 1000, and between 100 and 500 gm/24 hours-100 square inches. The front panel can comprise any suitable material. Preferred is a microperforated thermoplastic film of any suitable composition, hole size and hole density to achieve the desired MVTR. Preferred materials include ethylene/alpha-olefin copolymer, high density polyethylene, low density polyethylene, linear low density polyethylene, a blend of high density polyethylene and low density polyethylene, high density polyethylene with a filler, cellulose acetate, polyester, polyamide, or polypropylene. For the sake of clarity, panel 16 is illustrated herein as a monolayer film. However, multilayer films can also be beneficially used in connection with forensic evidence containers.

Also preferred for front panel 16 is a spun bonded olefin, such as a high density polyethylene fabricated by an integrated spinning and bonding process, such as the material available commercially from the DuPont Chemical Company under the trademark TYVEK®.

Other materials may also be employed provided they have a sufficiently high moisture vapor transmission rate.

Front panel 16 has a total thickness of preferably at least 2 mils, more preferably at least 3 mils. Front panel 16 is preferably between 1 and 15 mils thick, more preferably between 3 and 12 mils, most preferably between 5 and 10 mils thick, such as 8 mils thick.

Rear panel 18 has an MVTR of preferably equal to or less than 5 gm/24hour-100 square inches, more preferably less than 3, most preferably less than 2, such as less than 1.5, less than 1, and less than 0.5 gm/24 hours, 100 square inches (ASTM F 1249 for values at 20 grams or lower, ASTM E 96 for values above 20 grams, at 100% relative humidity). Preferred MVTR ranges are between 0 and 5 gm/24 hour-100 square inches, more preferably between 0.1 and 5 gm/24 hour-100 square inches, such as between 0.5 and 5, between 1 and 5, and between 2 and 4 gm/24 hours-100 square inches. Preferred materials include polypropylene and other polyolefins such as low density polyethylene, high density polyethylene, linear low density polyethylene, ethylene/alpha olefin copolymer, ethylene/(meth)acrylic acid copolymer; and other polymeric materials provided they can be made into a flexible panel. Other polymeric materials include polyamides, polyesters, and the like. Other materials may also be employed provided they have a sufficiently low moisture vapor transmission rate.

For the sake of clarity, panel 18 is illustrated herein as a monolayer film. However, multilayer films can also be beneficially used in connection with forensic evidence containers.

Rear panel 18 has a total thickness of preferably at least 1 mil, more preferably at least 2 mils. Rear panel 18 is preferably between 1 and 10 mils thick, more preferably between 2 and 19 mils, most preferably between 3 and 8 mils thick, such as between 5 and 7 mils, and most preferably 6 mils thick.

In manufacture, the front and rear panels are preferably bonded together, by heat sealing, gluing, or other bonding methods, along their respective side edges and bottom edges, to form a container having side edges 11 and 12 and bottom portion 14. The overall container has a preferably rectangular shape.

In the case of a microperforated panel 16, an alternative manufacturing method is to make a continuous single sheet of film, and apply microperforations in an intermittent manner. A longitudinal section of this film, having a microperforated segment and a segment without perforations, can then be severed from the continuous film. This section can then be folded about itself so as to form a front panel from the microperforated segment, and a rear panel from the unperforated segment. The respective sides of the panels can then be heat sealed, glued, or otherwise bonded together.

In the embodiment of FIGS. 1 and 2, rear panel 18 is longer than front panel 16. These panels together form an opening 20 into the interior of container 10. A closure portion 30 is in this embodiment a flap formed by the extended length of rear panel 18. Closure portion 30 includes an adhesive 24. A release liner 26 covers the adhesive 24 until such time as the container is loaded with forensic evidence and is to be closed. At this time, the release liner is peeled from adhesive 24 to expose the adhesive, and closure portion 30 is folded over the opening 20 and into contact with the front face of front panel 16 to securely close container 10. Tamper evident tape 35 is thus covered by a and in contact with a portion of adhesive 24, or a portion of tamper evident tape 35 is covered by a and in contact with adhesive 24. Thus, when the container is closed, an unauthorized tampering or effort to reopen the container will result in a visual indication of such tampering. Any tamper evident system can be used, such as thermochromic ink; non-thermochromic ink; aqueous evident ink; mechanical evident ink; or solvent evident ink, as disclosed above.

The front and rear panels 16 and 18 are preferably transparent or translucent, partially transparent or translucent, or a combination of opaque and transparent or translucent.

Figure 4:
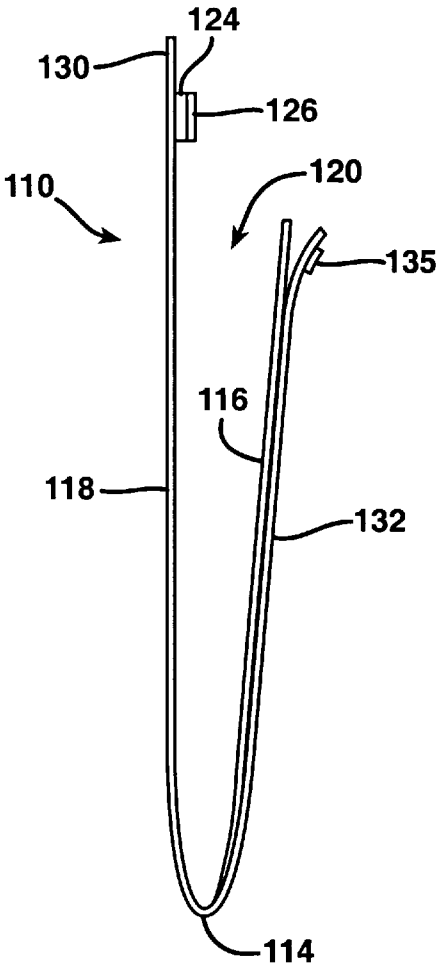
FIG. 4 is a diagrammatic cross-sectional side view of the forensic evidence container of FIG. 3.
Figure 3:
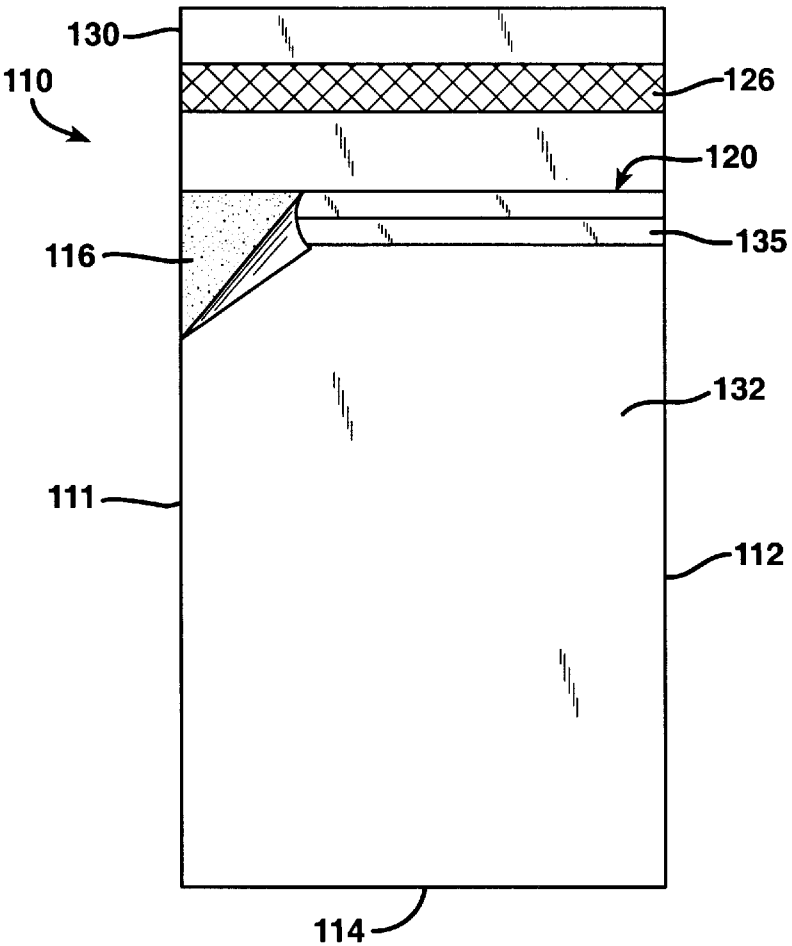
FIG. 3 is a diagrammatic front view of an open forensic evidence container in accordance with a second embodiment of the present invention.

Referring to FIGS. 3 and 4, a forensic evidence container 110 is preferably formed from a front panel 116 and a rear panel 118, each of flexible thermoplastic material. Reference numerals of FIGS. 3 and 4 refer to like numbered features of those of FIGS. 1 and 2, but with a "1" prefix added. Thus, e.g. adhesive 124 of FIG. 4 corresponds to adhesive 24 of FIG. 2.

A third flexible panel 132 is peelably adhered to front panel 116. The third panel can be adhered to the front panel by any suitable means, including e.g. glue, adhesive, or corona treatment. Adhesion of the third panel 132 to front panel 116 can be along the entire mating surfaces of these two panels, or alternatively along selected portions of either or both of the panels 116 and 132, as long as the result is that panel 132 is peelably adhered to panel 116.

Preferred peel strengths for the peelable bond between panels 132 and 116 range from 0.05 to 2 pounds/linear inch, more preferably 0.05 to 1.5 pounds/linear inch, and most preferably 0.05 to 1 pounds/linear inch, such as from 0.1 to 1 pound/linear inch. All peel strengths herein are determined in accordance with ASTM F-904.

Preferred materials for the third panel 132 and rear panel 118 are the preferred materials for the rear panel 18.

In the embodiment of FIGS. 3 and 4, the peelable panel 132 can be left in place in the event the end user sometimes desires a container wherein both outer panels have a low MVTR, for example when packaging dry evidence. In this case, the panel 132 can be left intact on the container. For damp or wet evidence where a container with a panel of high MVTR is desired, the same container can be used, but with panel 132 peeled away to expose the high MVTR panel 116. In the embodiment shown, a tamper evident device 135 is installed on the outside of panel 135.

Thus, closure of container 110, for example after loading the container with a forensic evidence article, includes removal of the release liner 126 if present, and pressing the exposed adhesive 124 to the exterior surface of the upper part of either panel 132 or, if panel 132 has been peeled away, to front panel 116.

Figure 6:
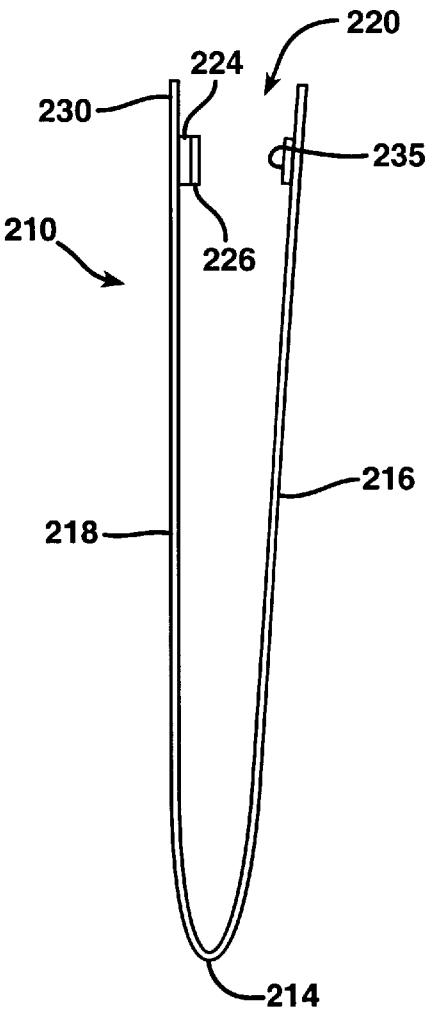
FIG. 6 is a diagrammatic cross-sectional side view of the forensic evidence container of FIG. 5.
Figure 5:
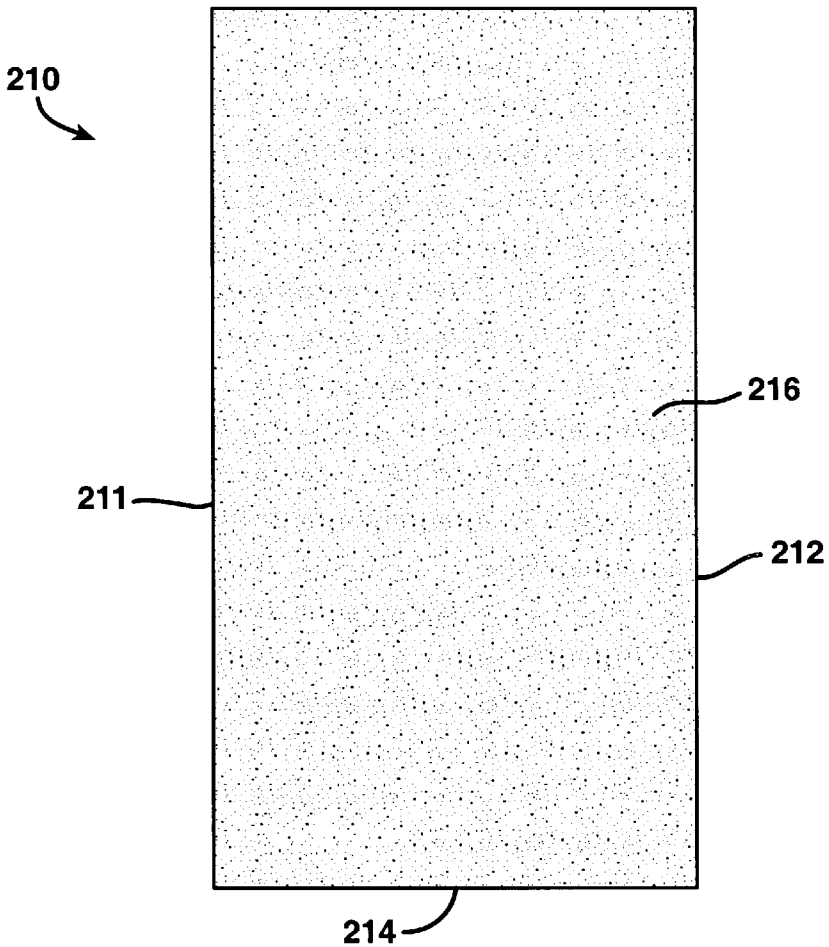
FIG. 5 is a diagrammatic front view of an open forensic evidence container in accordance with a third embodiment of the present invention.

Referring to FIGS. 5 and 6, a forensic evidence container 210 is preferably formed from a front panel 216 and a rear panel 218, each of flexible thermoplastic material. Reference numerals of FIGS. 5 and 6 refer to like numbered features of those of FIGS. 1 and 2, but with a "2" prefix added. It can be seen that the front and rear panels of FIGS. 5 and 6 are of the same or substantially the same length. Closure of the container, for example after loading the container with a forensic evidence article, includes removal of the release liner 226 if present, and pressing the exposed adhesive 224 to the interior surface of the upper part of front panel 216. Panels 216 and 218 can comprise any of the materials disclosed herein for panels 16 and 18 respectively of FIGS. 1 and 2.

Figure 8:
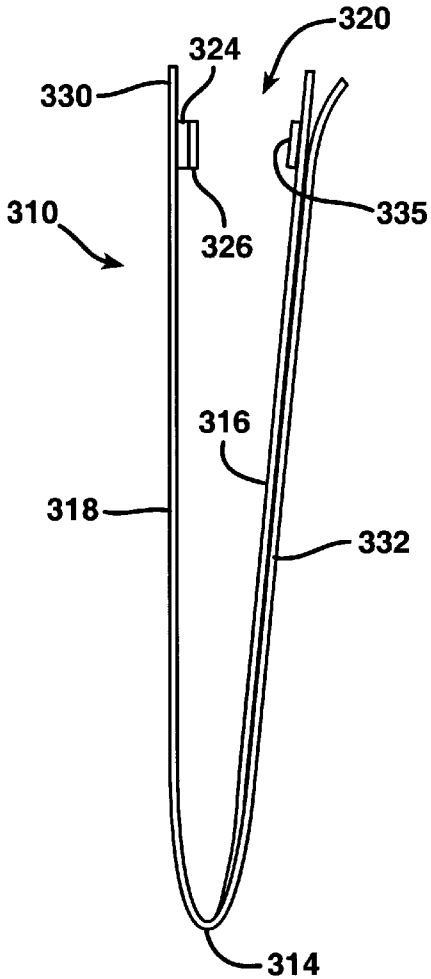
FIG. 8 is a diagrammatic cross-sectional side view of the forensic evidence container of FIG. 7.
Figure 7:
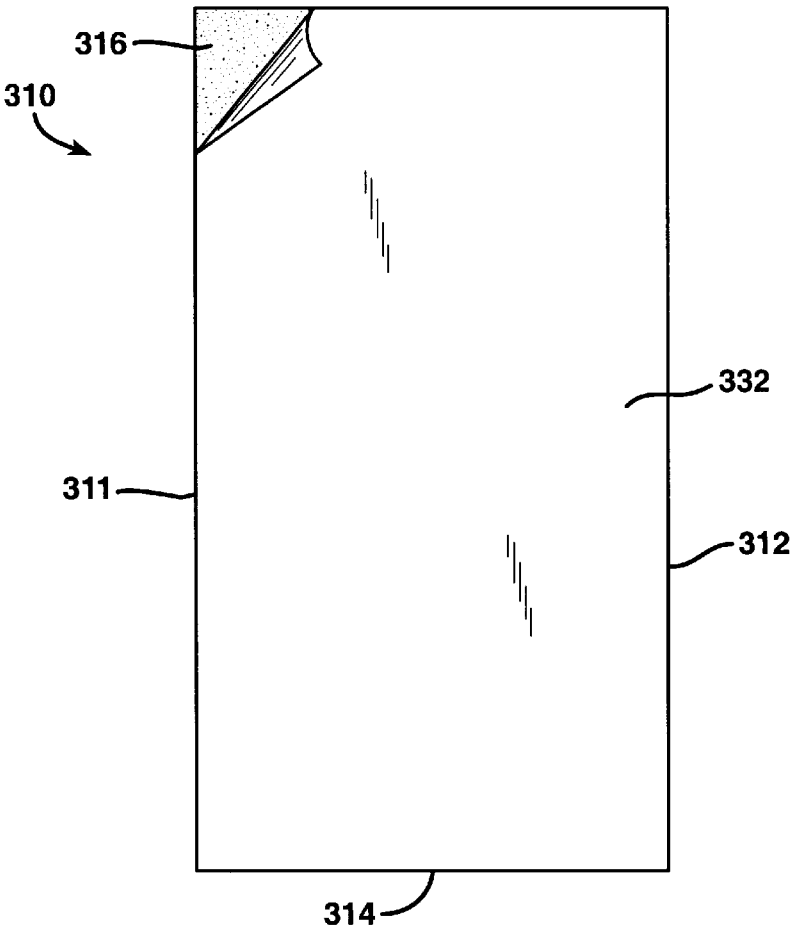
FIG. 7 is a diagrammatic front view of an open forensic evidence container in accordance with a fourth embodiment of the present invention.

Referring to FIGS. 7 and 8, a forensic evidence container 310 is preferably formed from a front panel 316 and a rear panel 318, each of flexible thermoplastic material. Reference numerals of FIGS. 5 and 6 refer to like numbered features of those of FIGS. 1 and 2, but with a "3" prefix added. It can be seen that the front and rear panels of FIGS. 5 and 6 are of the same or substantially the same length. A third panel 332 is peelably adhered to front panel 316. The third panel can be adhered to the front panel by any suitable means, including e.g. glue, adhesive, or corona treatment. Panel 332 corresponds to panel 132 of FIGS. 3 and 4.

Preferred peel strengths for the peelable bond between panels 332 and 316 range from 0.05 to 2 pounds/linear inch, more preferably 0.05 to 1.5 pounds/linear inch, and most preferably 0.05 to 1 pounds/linear inch, such as from 0.1 to 1 pound/linear inch.

Preferred materials for the third panel 332 are those preferred for the third panel 132, which in turn are the preferred materials for the rear panel 18.

In the embodiment of FIGS. 7 and 8, the peelable panel 332 can be left in place in the event the end user sometimes desires a container wherein both outer panels have a low MVTR, for example when packaging dry evidence. In this case, the panel 332 can be left intact on the container. For damp or wet evidence where a container with a panel of high MVTR is desired, the same container can be used, but with panel 332 peeled away to expose the high MVTR panel 316. In the embodiment shown, a tamper evident device 335 is installed on the upper interior end of panel 316.

Thus, closure of container 310, for example after loading the container with a forensic evidence article, includes removal of the release liner 326 if present, and pressing the exposed adhesive 324 to the exterior surface of the upper part of either panel 332 or, if panel 332 has been peeled away, to front panel 316.

Figure 10:
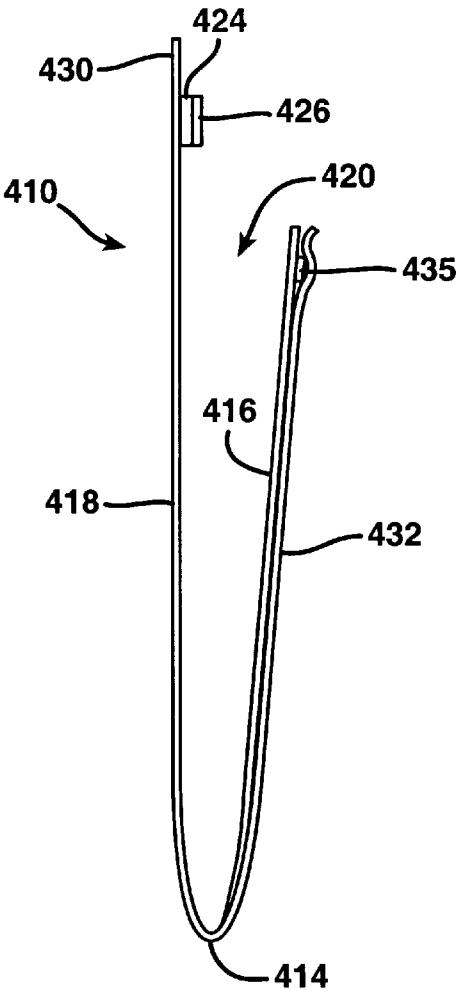
FIG. 10 is a diagrammatic cross-sectional side view of the forensic evidence container of FIG. 9.
Figure 9:
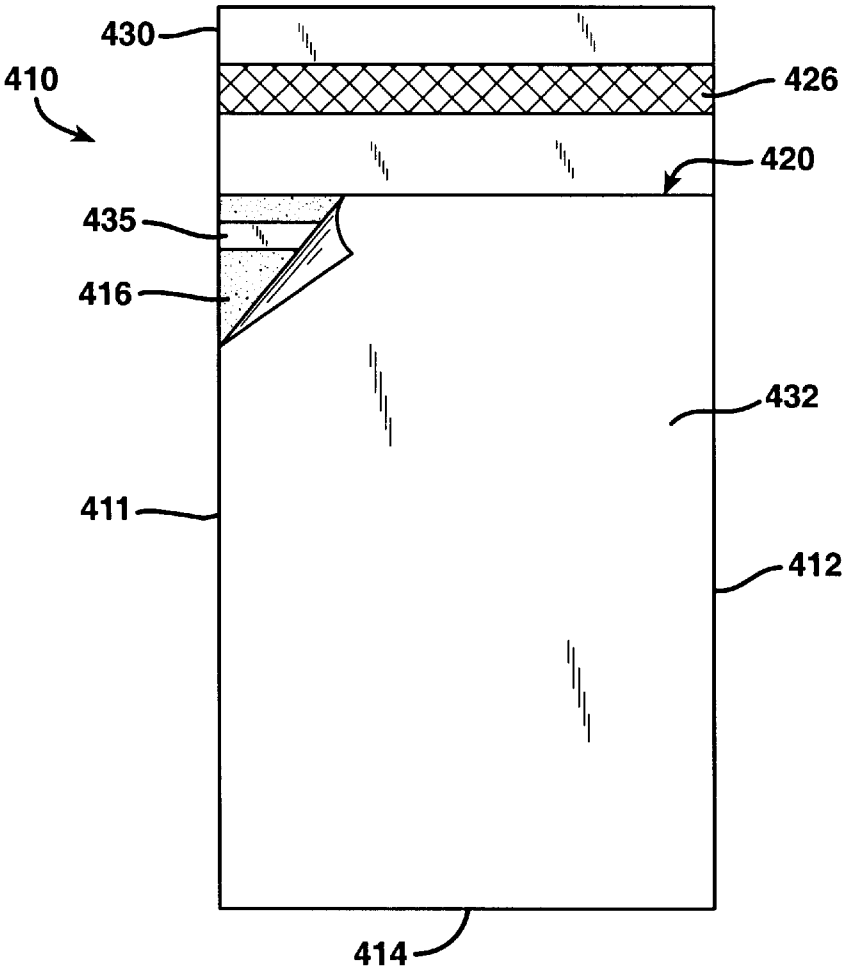
FIG. 9 is a diagrammatic front view of an open forensic evidence container in accordance with a fifth embodiment of the present invention.

Referring to FIGS. 9 and 10, a forensic evidence container 410 is like container 110 of FIGS. 3 and 4 in most respects, but in which the tamper evident device 435 is disposed on panel 416 and sandwiched between panel 416 and peelable panel 432. Such an arrangement may be preferred where it is likely that the peelable panel 432 is to be peeled away before the container 410 is used. The features, materials, operation, and reference numerals of FIGS. 9 and 10 correspond to those of FIGS. 3 and 4 respectively, but with a "4" prefix for FIGS. 9 and 10 instead of the "1" prefix of FIGS. 3 and 4.

Figure 11:
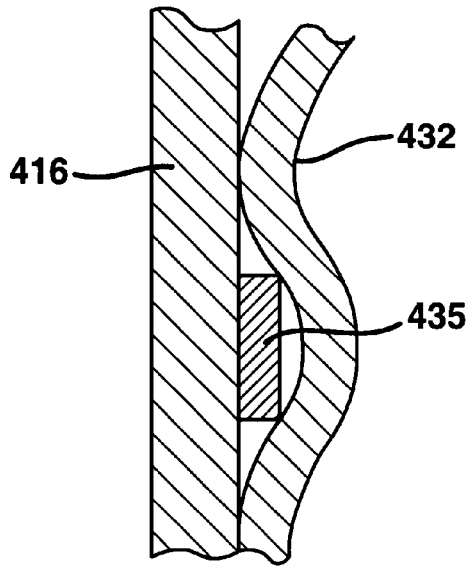
FIG. 11 is an enlarged diagrammatic cross-sectional side view of a portion of the forensic evidence container of FIG. 10.

FIG. 11 is an enlarged diagrammatic cross-sectional side view of a portion of the forensic evidence container of FIG. 10. The thickness of tamper evident device 435 is exaggerated for purposes of illustration.

Those skilled in the art will understand, after a review of the present application, that a tamper evident device could be installed on a given container, having a peelable third panel, both in the manner of the embodiment of FIGS. 9 and 10, and the embodiment of FIGS. 3 and 4. Thus, two tamper evident devices could be installed on a given container, one as shown in FIG. 4, on the exterior surface of the peelable panel, and one as shown in FIG. 10, sandwiched between a front panel. and the peelable panel.

Figure 12:
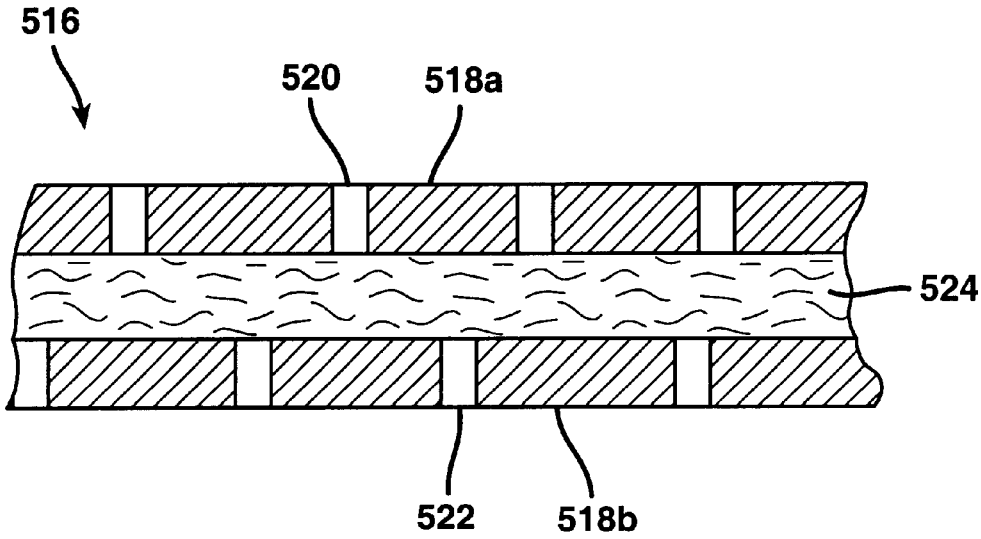
FIG. 12 is a diagrammatic section through an alternative high MVTR film panel in accordance with the invention.

FIG. 12 discloses a specific construction for a panel 516 having high MVTR, and suitable as a front panel 16, 116, 216, 316, 416, 616, or 716. Microperforated films 518*a* and 518*b* include microperforations 520 and 522 respectively. Sandwiched between these films is an intermediate layer 524 containing a moisture absorbent or moisture adsorbent. Preferred materials for layer 524 include silica gel, absorbent paper, lacerated paper, filter paper, absorbent pad, open cell polymeric foam, microspheres, nano particles, and ion exchange resin dispersed media. A commercially available absorbent pad is the DRI-LOC® or PAD-LOCO® pad, both available from Sealed Air Corporation.

Figure 13:
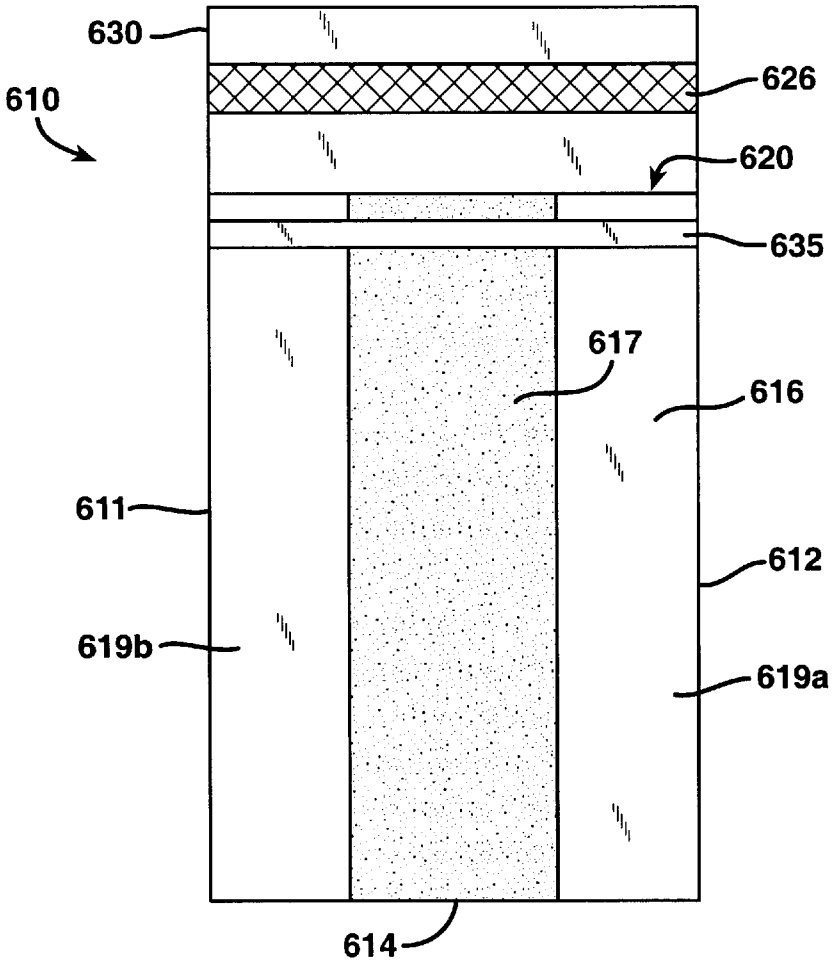
FIG. 13 is a diagrammatic front view of an open forensic evidence container in accordance with a sixth embodiment of the present invention.

FIG. 13 discloses an alternative embodiment in which only a portion 617 of front panel 616 comprises a high MVTR material. The remaining portions 619*a*, 619*b* of front panel 616 comprise a low MVTR material. Thus, the front panel 616 corresponds structurally to panel 16 of FIG. 1. However, only panel portion 617 of FIG. 13 corresponds to front panel 16 in terms of the material choices, i.e. a material with high MVTR. The remaining panel portions 619*a* and 619*b* of FIG. 13 correspond to rear panel 18. of FIG. 1 in terms of the material choices, i.e. a material with low MVTR.

In all other respects, reference numerals of FIG. 13 refer to like numbered features of FIG. 1, but with a "6" prefix added. Thus, e.g. tamper evident device 635 of FIG. 13 corresponds to device 35 of FIG. 1.

The embodiment of FIG. 13 is especially useful in end-use applications where it is desired to have a portion of, but not all of, a given panel with a high MVTR. Those skilled in the art will understand after a review of the present application, that this embodiment can be practiced in a variety of packaging formats. For example, a horizontal band of high MVTR material can form part of the front panel, rather than a vertical band as shown in FIG. 13. Alternatively, more than one band of high MVTR material can be used, in the form of strips or sections of the front panel of the container. This strips or bands need not all have the same MVTR, but can be selected to achieve the desired final MVTR for the container.

Figure 14:
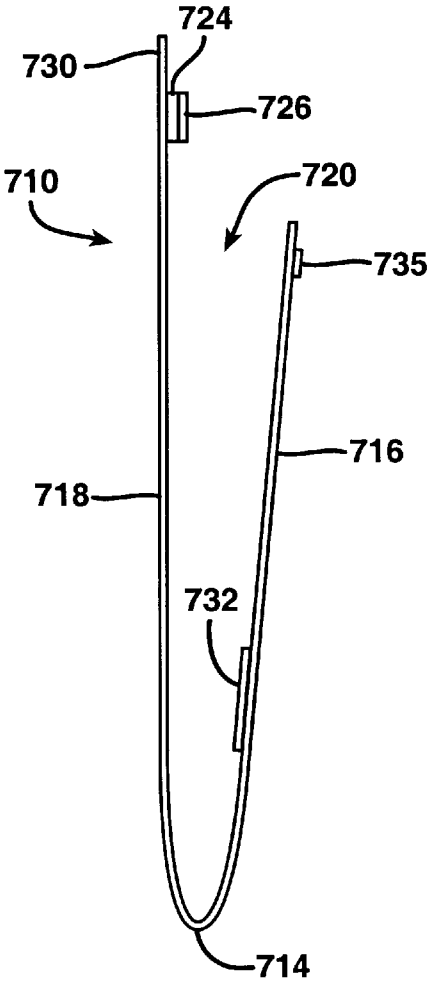
FIG. 14 is a diagrammatic cross-sectional side view of a forensic evidence container in accordance with a seventh embodiment of the present invention.

FIG. 14 discloses a container 710 like that of FIG. 1. Reference numerals of FIG. 14 refer to like numbered features of FIG. 1, but with a "7" prefix added. Thus, e.g. tamper evident device 735 of FIG. 14 corresponds to device 35 of FIG. 1. A pad 732 is installed on an interior surface of front panel 716. Pad 732 can comprise any material or construction that takes up and/or transfers liquid water or moisture vapor from the interior of the container. It can comprise the absorbent pad or panel disclosed in connection with FIG. 12. The pad 732 can be disposed on the interior surface of panel 716, as shown, or on the exterior surface of panel 716. It can be sized according to the desired final MVTR, rate of water or vapor absorption or adsorption, etc. It is required that at least a portion of front panel 716 have a high MVTR as disclosed herein, in the vicinity of the pad 732, to provide adequate egress of water and/or water vapor from the interior to the exterior of the container. Thus, e.g. the portion of panel 716 in contact with pad 732 is a TYVEK® polyolefin, or a microperforated film.

Although for purposes of convenience and economy the invention has been described herein with reference to a front panel of high MVTR and a rear panel of low MVTR, those skilled in the art will understand, after a reading of this application, that the rear panel can alternatively have a high MVTR, and the front panel can have a low MVTR, as described herein. In this alternative, the peelable third panel if present would then be disposed over the rear panel.

Also, although the invention is described in some embodiments as including a peelable third panel, end-use applications may be present in which either the peelable third panel is not included, or else is included but is not utilized (i.e. peeled away) at the time of packaging a forensic evidence article.

In yet another alternative embodiment, both the first and second panels comprise a material having a moisture vapor transmission rate of at least 10 gm/24 hour-100 square inches. The first and second panels would thus each comprise any of the high MVTR materials disclosed herein, such as the TYVEK® material, or the microperforated film, or the moisture absorbent material bonded on one or both sides to a microperforated film. In such an embodiment, a peelable panel of low MVTR can optionally be used in conjunction with one or both of the high MVTR panels.

Although the invention has been described herein primarily with respect to forensic evidence containers for the packaging of biological materials or specimens, test samples, DNA evidence, forensic or criminal evidence, the invention can also be beneficially used in connection with the packaging or containment or any other product or item requiring some protection against tampering, theft, substitution, destruction, chemical or physical alteration, etc.

Also, although the article of the invention has been described herein primarily as a forensic evidence container such as a security envelope, other articles can also be beneficially made utilizing the indicator of the invention. These articles include labels, tapes, air cushioning films, shrink and non-shrink films, laminates.

It is to be understood that variations of the present invention can be made without departing from the scope of the invention, which is not limited to the specific embodiments and examples disclosed herein, but extends to the claims presented below.

What is claimed is:

1. A forensic evidence container comprises:

a) a first flexible panel having a first and second side edge, and a bottom edge, the first flexible panel comprising a material having a moisture vapor transmission rate of at least 10 gm/24 hours-100 square inches;

b) a second flexible panel having a first and second side edge, and a bottom edge, the first and second side edges in communication with the first and second edges respectively of the first panel, and the bottom edge in communication with the bottom edge of the fist panel, the second flexible panel comprising a material having a moisture vapor transmission rate of equal to or less than 5 gm/24 hours-100 square inches;

c) a bottom portion formed by the bottom edge of the first panel and the bottom edge of the second panel;

d) an opening capable of providing access to the interior of the forensic evidence container;

e) an adhesive, applied to the first panel or second panel, having a free surface so arranged as to seal the opening on superposition of the first panel and the second panel; and f) a tamper evident device arranged on the first or second panel; wherein the material having a moisture vapor transmission rate of at least 10 gm/24 hours-100 square inches is selected from the group consisting of spunbonded olefin, and microperforated thermoplastic film.

2. The forensic evidence container of claim 1 wherein the material having a moisture vapor transmission rate of at least 10 gm/24 hour-100 square inches comprises the microperforated thermoplastic film, and a moisture absorbent medium adhered to the microperforated thermoplastic film.

3. The forensic evidence container of claim 2 wherein the moisture absorbent medium is selected from the group consisting of silica gel, absorbent paper, filter paper, absorbent pad, open cell polymeric foam, microspheres, nano particles, and ion exchange resin dispersed media.

4. The forensic evidence container of claim 1 wherein the material having a moisture vapor transmission rate of at least 10 gm/24 hours-100 square inches comprises the microperforated thermoplastic film, a second microperforated thermoplastic film, and a moisture absorbent medium disposed between the microperforated film and the second microperforated thermoplastic film.

5. The forensic evidence container of claim 4 wherein the moisture absorbent medium is selected from the group consisting of silica gel, absorbent paper, filter paper, absorbent pad, open cell polymeric foam, microspheres, nano particles, and ion exchange resin dispersed media.

6. The forensic evidence container of claim 1 wherein the material having a moisture vapor transmission rate of equal to or less than 5 gm/24 hours-100 square inches comprises polypropylene.

7. The forensic evidence container of claim 1 comprising a third flexible panel comprising a material having a moisture vapor transmission rate of equal to or less than 5 gm/24 hours-100 square inches, the third flexible panel peelably bonded to the fist panel.

8. The forensic evidence container of claim 7 wherein the third panel is bonded to the first panel with a bond strength of between 0.05 and 2 pound/linear inch.

9. The forensic evidence container of claim 7 wherein the third panel comprises polypropylene.

10. The forensic evidence container of claim 1 wherein the adhesive is disposed as a band on the first panel or second panel.

11. The forensic evidence container of claim 1 wherein the second panel is longer than the first panel.

12. The forensic evidence container of claim 11 comprising a closure portion formed integrally with the second panel.

13. The forensic evidence container of claim 1 wherein the first and second panels are of substantially equal length.

14. The forensic evidence container of claim 13 comprising a closure portion formed integrally with the second panel.

15. The forensic evidence container of claim 1 wherein a releasable cover-strip is provided on the free surface of the adhesive.

16. The forensic evidence container of claim 1 wherein the opening is formed between the first panel and the second panel.

17. The forensic evidence container of claim 1 wherein the tamper evident device comprises a composition selected from the group consisting of:

i) thermochromic ink;

ii) non-thermochromic ink;

iii) aqueous evident ink:

iv) mechanical evident ink:

v) solvent evident ink: and vi) deactivating agent.

18. A package comprising:

a) a container comprising i) a first flexible panel having a first and second side edge, and a bottom edge, the first flexible panel comprising a material having a moisture vapor transmission rate of at least 10 gm/24 hours-100 square inches;

ii) a second flexible panel having a first and second side edge, and a bottom edge, the first and second side edges in communication with the first and second edges respectively of the first panel, and the bottom edge in communication with the bottom edge of the first panel, the second flexible panel comprising a material having a moisture vapor transmission rate of equal to or less than 5 gm/24 hours-100 square inches;

iii) a bottom portion formed by the bottom edge of the first panel and the bottom edge of the second panel;

iv) an opening, capable of providing access to the interior of the forensic evidence container;

v) an adhesive, applied to the first panel or second panel, having a free surface so arranged as to seal the opening on superposition of the first panel and the second panel; and vi) a tamper evident device arranged on the first or second panel;

wherein the material having a moisture vapor transmission rate of at least 10 gm/24 hours-100 square inches is selected from the group consisting of spun-bonded olefin, and microperforated thermoplastic film; and b) a forensic evidence article disposed inside the container of a).

* * * * *

UNITED STATES PATENT AND TRADEMARK OFFICE

CERTIFICATE OF CORRECTION

PATENT NO. : 6,632,403 B1 
DATED : October 14, 2003
INVENTOR(S) : Charles R. Barmore, Charles Kannankeril and Rengan Kannabiran It is certified that error appears in the above-identified patent and that said Letters Patent is hereby corrected as shown below:

Title page, Item [54] and Column 1, line 1,
"FORSENIC" should be -- FORENSIC --.

Column 9,
Line 56, "fist" should be -- first --.

Column 10,
Line 8, "hour-" should be -- hours --.
Line 36, "fist" should be -- first --.
Line 39, "pound" should be -- pounds --.

Signed and Sealed this

Thirtieth Day of December, 2003

JAMES E. ROGAN
*Director of the United States Patent and Trademark Office*